US010514135B2

(12) United States Patent
Shibata et al.

(10) Patent No.: US 10,514,135 B2
(45) Date of Patent: Dec. 24, 2019

(54) LIGHT EMITTING DEVICE

(71) Applicant: NICHIA CORPORATION, Anan-shi, Tokushima (JP)

(72) Inventors: Hironobu Shibata, Tokushima (JP); Soichiro Miura, Tokushima (JP); Takashi Namie, Anan (JP)

(73) Assignee: NICHIA CORPORATION, Anan-shi (JP)

( * ) Notice: Subject to any disclaimer, the term of this patent is extended or adjusted under 35 U.S.C. 154(b) by 37 days.

(21) Appl. No.: 15/678,375

(22) Filed: Aug. 16, 2017

(65) Prior Publication Data

US 2018/0058642 A1 Mar. 1, 2018

(30) Foreign Application Priority Data

Aug. 30, 2016 (JP) ..... 2016-168031

(51) Int. Cl.

| | |
|---|---|
| ***F21K 9/64*** | (2016.01) |
| ***F21V 7/22*** | (2018.01) |
| ***F21V 19/00*** | (2006.01) |
| ***F21V 7/04*** | (2006.01) |
| ***F21V 13/08*** | (2006.01) |
| ***F21Y 115/30*** | (2016.01) |
| ***F21V 9/00*** | (2018.01) |

(52) U.S. Cl.

CPC ..... *F21K 9/64* (2016.08); *F21V 7/041* (2013.01); *F21V 7/22* (2013.01); *F21V 13/08* (2013.01); *F21V 19/0025* (2013.01); *F21V 9/00* (2013.01); *F21Y 2115/30* (2016.08)

(58) Field of Classification Search

CPC ... F21K 9/64; F21V 7/041; F21V 7/22; F21V 13/08; F21V 19/0025; F21V 9/00; F21Y 2115/30

USPC ..... 362/259

See application file for complete search history.

(56) References Cited

U.S. PATENT DOCUMENTS 8,872,203 B2 * 10/2014 Nagahama ..... H01L 33/483 257/98

2008/0116473 A1 5/2008 Sugiyama (Continued)

FOREIGN PATENT DOCUMENTS

JP 2000-294831 A 10/2000

JP 2005-216962 A 8/2005

(Continued)

*Primary Examiner* — Britt D Hanley

(74) *Attorney, Agent, or Firm* — Global IP Counselors, LLP

(57) ABSTRACT

A light emitting device includes a semiconductor laser element configured to emit a first light, a wavelength converting member configured to emit a second light upon being irradiated by the first light, and a support member defining a through-hole allowing an optical path of the first light to pass through. The through-hole is defined by, in order from a light incident side to a light emitting side with respect to the first light, a lower portion with opening width decreasing from the light incident side to the light emitting side, and an upper portion where the wavelength converting member is fixed. The semiconductor laser element is disposed at a location allowing the first light to enter the lower portion of the through-hole while also allowing a part of the first light to be reflected at a wall defining the lower portion of the through-hole.

19 Claims, 7 Drawing Sheets

(56) References Cited

U.S. PATENT DOCUMENTS

| | | | |
|---|---|---|---|
| 2014/0085923 | A1 | 3/2014 | Nakazato |
| 2014/0160782 | A1 | 6/2014 | Harada |

FOREIGN PATENT DOCUMENTS

| | | | | |
|---|---|---|---|---|
| JP | 2005-243738 | A | | 9/2005 |
| JP | 2008-153617 | A | | 7/2008 |
| JP | 5326705 | B2 | * | 10/2013 |
| JP | 2014-067961 | A | | 4/2014 |
| JP | 2014-116081 | A | | 6/2014 |
| JP | 2014-175644 | A | | 9/2014 |

* cited by examiner

LIGHT EMITTING DEVICE

CROSS-REFERENCE TO RELATED PATENT APPLICATION

The present application claims priority under 35 U.S.C. § 119 to Japanese Patent Application No. 2016-168031, filed on Aug. 30, 2016. The contents of Japanese Patent Application No. 2016-168031 are incorporated herein by reference in their entirety.

BACKGROUND

1. Technical Field

The present disclosure relates to a light emitting device.

2. Description of Related Art

Light emitting devices using laser diodes as their light source have been proposed, as in Japanese Unexamined Patent Application Publication No. 2008-153617 and Japanese Unexamined Patent Application Publication No. 2014-175644.

Those light emitting devices include a semiconductor laser element, a support member covering the semiconductor laser element and defining a through-hole with an opening above the semiconductor laser element, and a wavelength converting member disposed to cover the opening of the through-hole, so that light from the semiconductor laser element is emitted through the wavelength converting member.

SUMMARY

Laser light has high intensity at the center of its optical path, so that when light from a semiconductor laser element is directly irradiated on a wavelength converting member that has a small thickness, a portion of the laser light around the center of its optical path may pass through the wavelength converting member without having its wavelength converted. This may result in, for example, a reduction in the uniformity of the chromaticity or the like. Meanwhile, the greater the thickness of the wavelength converting member, the less light to pass through the wavelength converting member, resulting in a reduction in the light extraction efficiency. Thus, the thickness of the wavelength converting member and the light extraction efficiency of the light emitting device are in trade-off relation. When the wavelength converting member has a small size in a top view, closely placing the wavelength converting member and the laser aperture can improve the arrival ratio of laser light reaching the wavelength converting member, but in order to avoid collision between the components, a certain degree or more of spacing is necessarily provided.

Further, placing a lens between the wavelength converting member and the semiconductor laser element to condense and guide the laser light into the wavelength converting member allows downsizing the wavelength converting member while obtaining high arrival ratio of the laser light to the wavelength converting member, but on the other hand, highly precise placing of the lens is required and downsizing of the light emitting device becomes difficult.

One aim of the present disclosure is to realize downsizing of a light emitting device that employs a semiconductor laser element, with a simpler configuration while also improving the light extraction efficiency of the light emitting device.

The present disclosure includes the aspects described below.

A light emitting device includes a semiconductor laser element configured to emit a first light, a wavelength converting member configured to emit a second light upon being irradiated by the first light, and a support member defining a through-hole allowing an optical path of the first light to pass through. The through-hole is defined by, in order from a light incident side to a light emitting side with respect to the first light, a lower portion with opening width decreasing from the light incident side to the light emitting side, and an upper portion where the wavelength converting member is fixed. The semiconductor laser element is disposed at a location allowing the first light to enter the lower portion of the through-hole while also allowing a part of the first light to be reflected at an inner wall defining the lower portion of the through-hole.

According to the present disclosure, downsizing of a light emitting device that employs a semiconductor laser element can be realized with a simple configuration, while achieving an improvement in the light extraction efficiency.

DETAILED DESCRIPTION

Figure 1A:
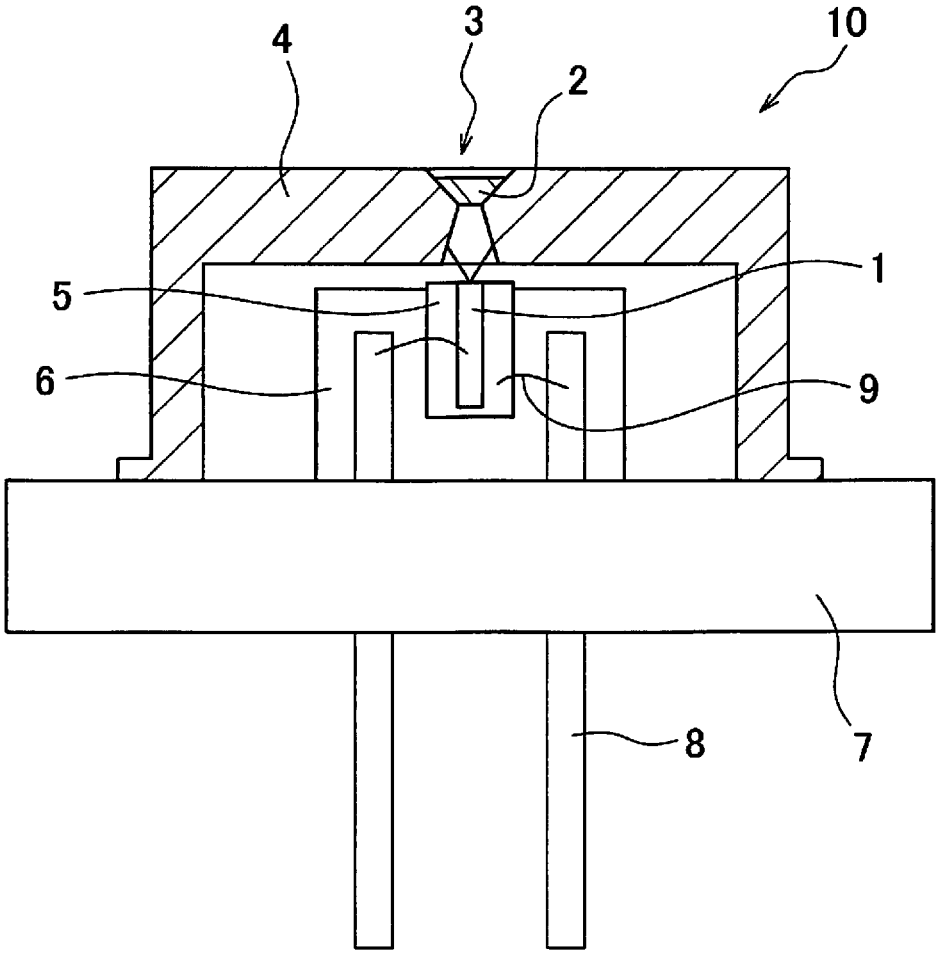
FIG. 1A is a schematic cross-sectional view showing a light emitting device according to one embodiment of the present invention.

Certain embodiments of the present invention will be described below with reference to the accompanying drawings. It is to be noted that the light emitting device described below is intended for implementing the technical concept of the present invention, and the present invention is not limited to those described below unless otherwise specified. Also, description given in one embodiment and/or one example can be applied to other embodiments and/or other examples. Note that, the size, positional relationship and the like in the drawings may be exaggerated for the sake of clarity.

First Embodiment

Figure 1B:
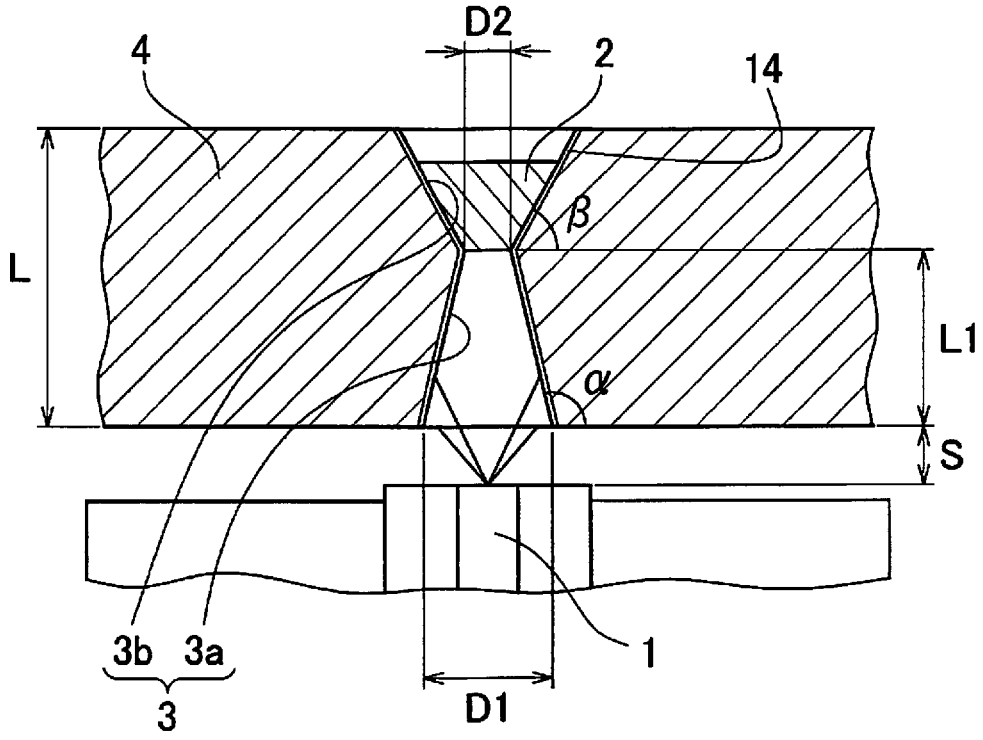
FIG. 1B is a partially enlarged view of a main portion shown in FIG. 1A.

A light emitting device 10 according to a first embodiment includes, for example, as shown in FIGS. 1A and 1B, a semiconductor laser element 1, a support member 4 defining a through-hole 3 allowing an optical path of the semiconductor laser element 1 to pass through, and a wavelength converting member 2.

The through-hole 3 is defined by, in order from a light incident side to a light emitting side, a lower portion 3*a* with opening width decreasing from the light incident side to the light emitting side, and an upper portion 3*b*.

The semiconductor laser element 1 is disposed at a location allowing a first light emitted from the semiconductor laser element 1 entering the lower portion 3*a* and reflected at an inner wall defining the lower portion 3*a*.

Figure 2:
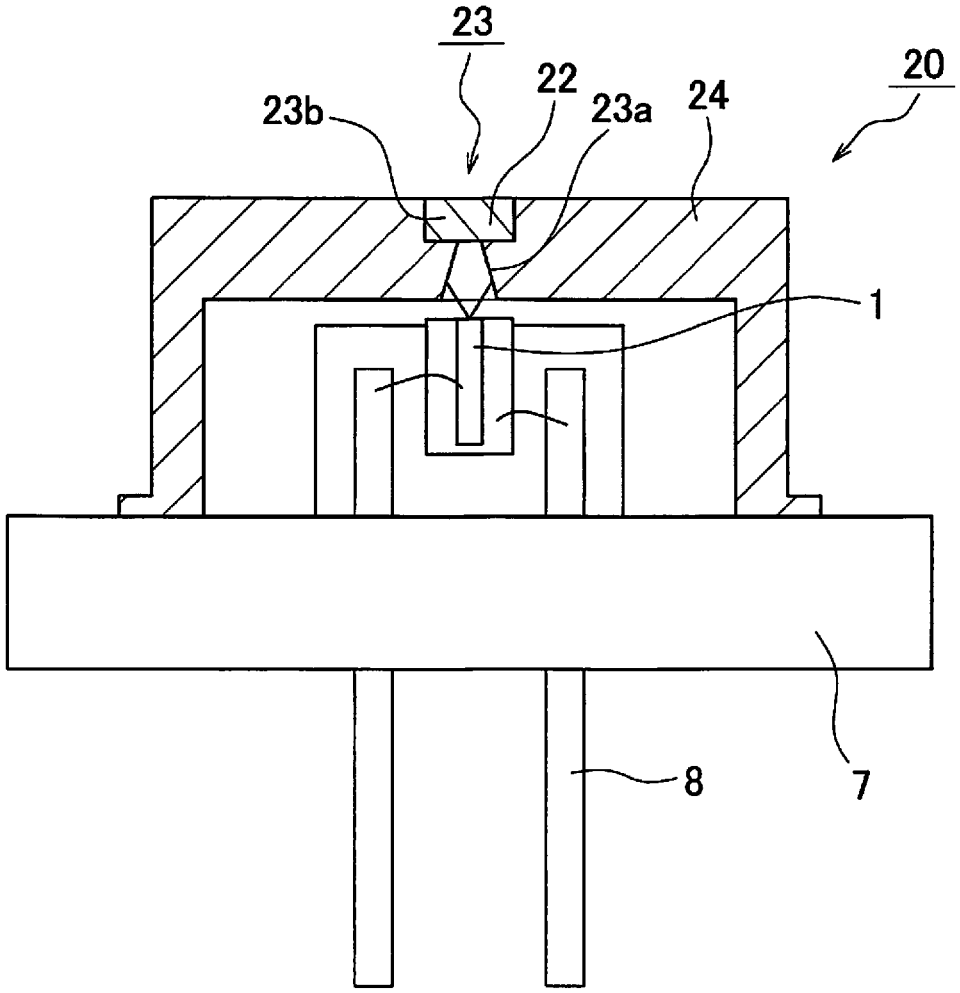
FIG. 2 is a schematic cross-sectional view showing a light emitting device according to another embodiment of the present invention.
Figure 3:
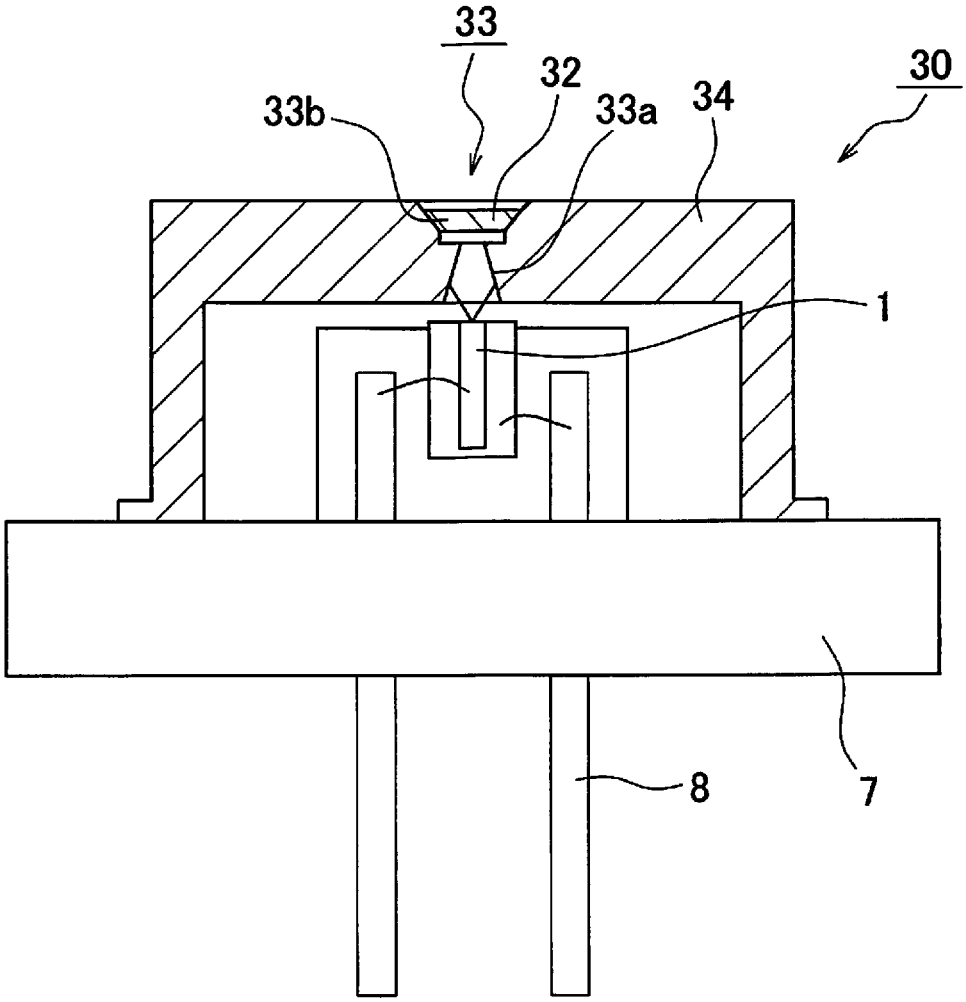
FIG. 3 is a schematic cross-sectional view showing a light emitting device according to a still another embodiment of the present invention.

In the present specification, laser light emitted from the semiconductor laser element may be referred to as a "first light", and wavelength-converted light of the first light irradiated on the wavelength converting member and wavelength converted by the wavelength converting member may be referred to as a "second light". Also, in the present specification, an "upper side" is a light emitting side of the light emitting device and a "lower side" is an opposite side of the upper side. FIGS. 1A and 1B are cross-sectional views respectively illustrating a state of the support member 4 and the wavelength converting member 2 along a penetrating direction of the through-hole 3. FIG. 2 and FIG. 3 to be described below are also cross-sectional views of similar manner.

In the light emitting device 10, the lower portion 3*a* of the through-hole 3 is defined by an inner wall with opening width decreasing from the light incident side toward the light emitting side (hereinafter may be expressed as "tapering"), so that light from the semiconductor laser element 1 entering the lower portion 3*a* of the through-hole 3 can be reflected inward and also upward at the inner wall defining the lower portion of the through-hole 3. Thus, in the light emitting device 10, the first light can be reflected at the inner wall defining the lower portion 3*a*, allowing a reduction in spreading of the first light. With the configuration described above, a large portion of the laser light emitted from the semiconductor laser element 1 can be condensed to the wavelength converting member 2 without using a lens, which also allows for emission of high luminance from the light emitting device 10. Accordingly, the number of components in the light emitting device can be reduced and downsizing of the light emitting device can be realized.

Further, reflecting light at the inner wall defining the lower portion 3*a* allows a reduction in uneven distribution of laser intensity, that is, uneven distribution in which the center portion has a high intensity and peripheral portion has a low intensity can be reduced. That is, a peripheral portion of the laser light is reflected by the inner wall defining the lower portion 3*a* and is directed to an upper end of the lower portion 3*a*, facilitating an increase of the emission intensity of the peripheral portion of the laser light, and that can reduce the difference in the intensity between the center portion and the peripheral portion. Thus, unevenness in the chromaticity that passes the wavelength converting member 2 can be reduced. Consequently, a need for an increase in the thickness of the wavelength converting member 2 to reduce unevenness in the chromaticity becomes unnecessary, allowing for a reduction in the thickness of the wavelength converting member 2. Such a reduction in the thickness of the wavelength converting member 2 allows for a reduction in the scattering of light, and can further improve the light extraction efficiency of the light emitting device.

Further, in the light emitting device 10 having a configuration described above, even when the semiconductor laser element 1 is placed slightly misaligned with respect to the through-hole 3 defined in the support member 4, reflection can be used as long as the laser light is directed into the through-hole 3. Thus, even when the semiconductor laser element 1 is placed slightly misaligned, reduction in the light extraction efficiency can be reduced and unevenness in quality can be reduced, and consequently, production yield can be improved.

Semiconductor Laser Element 1

For the semiconductor laser element 1, for example, an element having a semiconductor layer, for example, a nitride-based semiconductor (typically represented by $In_xAl_yGa_{1-x-y}N$, $0 \le x$, $0 \le y$, $x+y \le 1$), an InAlGaAs-based semiconductor, an InAlGaP-based semiconductor. By adjusting the materials and their compositions, the oscillation wavelength of the semiconductor laser element 1 can be adjusted. For example, the semiconductor laser element 1 having an active layer of a quantum well structure that contains an InGaN well layer, and an oscillation wavelength in a range of 400 nm to 530 nm can be used.

Support Member 4

The support member 4 is configured to support the wavelength converting member 2 to be described further below, and also to cover the semiconductor laser element 1.

The support member 4 can have a shape provided with a through-hole 3 that allows light of the semiconductor laser element 1 to pass through and can support the wavelength converting member 2. Various appropriate shapes such as a plate-like shape, a cylindrical shape, or the like, can be employed.

The support member 4 can have appropriate size and thickness according to the purpose of use. In view of heat dissipation performance and/or mechanical strength, and productivity, a thickness in a range of about 0.2 mm to about 2.0 mm is preferable.

The support member 4 of which at least the inner wall defining the through-hole 3 is preferably made of a reflecting material that hardly absorb light. In the specification, the expression "reflecting material" refers to a material that can reflect preferably 80% or greater, more preferably 90% or greater amount of light emitted from the light source, that is, the semiconductor laser element 1. The support member 4 is preferably made of a material having good thermal conductive property. In the specification, the expression "good thermal conductive property" refers to a thermal conductivity at 20° C. of several watts per meter per Kelvin (W/(m·K)) or greater, more preferably 25 W/m·K or greater, further preferably 50 W/m·K or greater. The support member 4 is preferably made of a material having good heat-resisting property. In the specification, the expression "good heat-resisting property" refers to a material having a melting point of, preferably, several hundred Celsius degrees or greater, more preferably a thousand Celsius degrees (1,000° C.) or greater.

Examples of the material of the support member 4 include ceramics, metals, and complex materials of those. Examples of the ceramics include silicon carbide, aluminum oxide, nitride silicate, and aluminum nitride, and examples of the metals include iron, copper, stainless steel, tungsten, tantalum, molybdenum, and Kovar. For example, when hermetically sealing the semiconductor laser element 1 by joining the support member 4 to the stem 7, a metal material that can be welded to the stem 7 is selected for the support member 4. Examples of such a metal material include Kovar. Alternatively, when a cover body to join the stem 7 is separately provided and the support member 4 is joined to the cover body, for example, ceramics having relatively high optical reflectance can be used as the support member 4. Examples of such ceramics include ceramics formed with a material mainly containing aluminum oxide.

The support member 4 shown in FIG. 1A is formed in a cylindrical shape, mainly made of a stainless steel that is an inexpensive and can easily be processed. The inner wall of the support member 4 defining the through-hole 3 is provided with a metallic reflecting film having higher reflectance than that of stainless steel, and the metallic reflecting film mainly contain silver. In the example shown in FIGS. 1A and 1B, the support member 4 has a cylindrical shape with a diameter of 6.8 mm with a thickness in the penetrating direction of the through-hole 3 (L in FIG. 1B) is 0.28 mm.

The support member 4 defines the through-hole 3 with a lower portion 3*a* and an upper portion 3*b*, in order from the light incident side toward the light emitting side with respect to light from the semiconductor laser element 1.

The lower portion 3*a* is defined tapering from the light incident side toward the light emitting side of the light. The inner wall defining the lower portion 3*a* preferably has an inclination angle in a range of 5 to 40 degrees with respect to the optical axis of the laser light emitted from the semiconductor laser element 1, which is more preferably in a range of 10 to 40 degrees, and further preferably in a range of 10 to 25 degrees. The inclination angle of the inner wall defining the lower portion 3*a* with respect to the optical axis of the laser light is α-90 in FIG. 1B. By setting the angle as described above, incident light can be reflected at the inner wall defining the lower portion 3*a* and efficiently directed toward the wavelength converting member 2.

When the upper portion 3*b* is narrower than the upper edge of the lower portion 3*a*, light from the lower portion 3*a* may return to the semiconductor laser element 1 side. Thus, the upper portion 3*b* is preferably formed with an opening width approximately the same as or greater than the opening width of the upper end of the lower portion 3*a*. The opening width may be either substantially uniform or increasing or decreasing from the light incident side to the light emitting side. Among those, from the light incident side to the light emitting side, a shape with substantially uniform opening width, a shape with increasing opening width, or a combination of those is preferably employed. The upper portion 3*b* has a shape with increasing opening width from the light incident side toward the light emitting side, which allows light returning toward the lower portion 3*a* to be reflected at the inner wall defining the upper portion 3*b* and can be emitted to the outside of the light emitting device 10. In this case, the inner wall defining the upper portion 3*b* preferably has an inclination angle in a range of 10 to 45 degrees with respect to the optical axis of the laser light emitted from the semiconductor laser element 1. The inclination angle of the inner wall defining the upper portion 3*b* is indicated as 90-β in FIG. 1B.

Increasing or decreasing in the width can either be slope-wise manner or step-wise manner. That is, through-hole 3 in the support member 4 can be defined by an approximately square shape, polygonal shape, circular shape, oval shape, or a shape which is a combination of those. The portion of the inner wall defining the upper portion 3*b* where the wavelength converting member 2 is fixed preferably has a surface with little irregularity so that the wavelength converting member 2 can be securely fixed.

The through-hole 3 can be defined with an appropriate total length L according to the size and thickness of the support member 4. The total length L may be, for example, in a range of about 0.2 mm to about 2.0 mm. The length L1 of the lower portion 3*a* may be in a range of 10% to 90% with respect to the total length L of the through-hole, and a range of 20% to 80% may be employed.

The lower portion 3*a* of the through-hole 3 is defined with a width decreasing from the light incident side toward the light emitting side. With this arrangement, light from the semiconductor laser element 1 incident on the lower portion 3*a* of the through-hole 3 can be reflected at the inner wall defining the lower portion 3*a* and efficiently extracted to the light emitting side. In particular, reflecting light at the inner wall defining the lower portion 3*a* allows for a reduction in uneven distribution of intensity across the cross-section of the laser light, that is, greater intensity in the central portion and smaller intensity in the periphery. Accordingly, uneven chromaticity on the wavelength converting member 2 can be reduced. Further, with this arrangement, a need of increasing the thickness of the wavelength converting member 2 that allow a reduction of unevenness in the chromaticity can be avoided, so that the wavelength converting member 2 of a small thickness can be realized. With this arrangement, scattering of light by the wavelength converting member 2 can be reduced and the light extraction efficiency can be further improved.

The shape defining the through-hole 3 in a plan view from the light incident side can be, for example, a circular shape, an elliptic shape, a polygonal shape such as a triangular shape, or a quadrangular shape. The cross-section of the laser light emitted from the semiconductor laser element 1 is an elliptic shape, so that a circular shape or an elliptic shape is preferably employed.

The through-hole 3 is defined with an opening width sufficient to allow the laser light emitted from the semiconductor laser element 1 to pass through. The size of the opening of the light incident side of the through-hole 3 is preferably sufficient to allow substantially the entire laser light including the central portion of the laser light, emitted from the semiconductor laser element 1, to enter the through-hole 3. The expression "substantially the entire laser light including the central portion of the laser light" means more specifically, all portion of the laser light defined as the beam opening width. The beam opening width is defined by, for example, the width at which the intensity decreases to $1/e^2$ of its peak intensity. For example, the opening area at the light incident side of the through-hole 3 can be set in the range expressed in the formula (1) below.

$$\pi\times\left((S-0.2)\times\tan\frac{(R-10)}{2}\right)^2 \le A \le \pi\times\left((S+0.2)\times\tan\frac{(R+15)}{2}\right)^2 \quad (1)$$

(In the formula, A is an opening area ($mm^2$) at the light incident side of the through-hole 3. S is a shortest distance (mm) between the semiconductor laser element 1 and the support member 4. R is a diverging angle) (°) of laser light emitted from the semiconductor laser element 1.)

In the present specification, the term "(a) diverging angle of laser light emitted firm the semiconductor laser element 1" refers to a total angle of the beam opening width of the laser light. Further, the opening area A at the light incident side of the through-hole 3 is preferably set in the range expressed in the formula (2) below. Thus, of the laser light emitted from the semiconductor laser element 1, all portions of the laser light defined as the beam opening width can be guided into the through-hole 3.

$$\pi\times\left(S\times\tan\frac{R}{2}\right)^2 < A \le \pi\times\left((S+0.2)\times\tan\frac{(R+15)}{2}\right)^2 \quad (2)$$

More specifically, although it depends on the type of the semiconductor laser element 1, at the end of the light incident side of the through hole 3 where the laser light from the semiconductor laser element 1 enters, that is, at the lower surface of the support member 4, the opening width D1 of the through-hole 3 is preferably in a range of 0.1 mm to 5.0 mm.

The width D2 at the upper end of the lower portion 3*a* is small so that at least a portion of peripheral portion of the laser light is reflected at the inner wall defining the lower portion 3*a*. A cross-section of laser light is, for example, an elliptic shape with a longitudinal width (perpendicular to the surface of the semiconductor layer) greater than a lateral width (parallel to the surface of the semiconductor layer). Thus, the width D2 is preferably set small so that the both longitudinal ends in the cross-section of the laser light are reflected at the inner wall defining the lower portion 3*a*. Accordingly, unevenness in the intensity distribution of the laser light can be further reduced. The smaller the width D2 of the through-hole 3, the smaller the cross-sectional area of the laser light at the upper end of the lower portion 3*a*, that is, a closer to ideal point light source can be obtained. Meanwhile, the closer the laser light to a point light, the greater the optical density, which causes a rise in the temperature of heat generated in the wavelength converting member 2. For this mason, the width D2 of the through-hole 3 is preferably 4.0 mm or less, more preferably in a range of 0.05 mm to 4.0 mm.

In the specification, at a given location in the through hole, "a width of through-hole 3" refers to a maximum length of the through-hole 3 in a direction substantially perpendicular to the optical axis of the laser light emitted from the semiconductor laser element 1. For example, when the cross-sectional shape in a perpendicular direction of the optical axis of the laser light is a circular shape, the width of the through-hole 3 is the diameter of the through-hole 3.

The closer the opening at the light incident side of the through-hole 3, that is at the lower end of the through-hole 3, and the semiconductor laser element 1 are, the easier to introduce light emitted from the semiconductor laser element 1 in the through-hole 3, and thus efficient wavelength conversion can be performed in the wavelength converting member 2. More specifically, the distance between the support member 4 and the semiconductor laser element 1 is preferably adjusted so that the shortest distance S between the opening at the light incident side of the through-hole 3 and the semiconductor laser element 1 is smaller than the width D1 of the opening at the light incident side of the through-hole 3. Meanwhile, from another point of view, the shortest distance between the opening at the light incident side of the through-hole 3 and the semiconductor laser element 1 is preferably smaller than three times the length L1 of the lower portion 3*a* of the through-hole 3. Further, the shortest distance S is preferably smaller than D1 and also smaller than three times of L1. Accordingly, approximately all light emitted from the semiconductor laser element 1 can be directed into the through-hole 3, and thus efficient conversion can be performed in the wavelength converting member 2. Meanwhile, when the shortest distance S is set to 0 (zero) or less, possibility of the support member 4 get in contact with the semiconductor laser element 1 at the time of mounting the support member 4 increases, so that the shortest distance S is preferably greater than 0 (zero).

The inclination angle, shape, and the like are preferably set in the ranges described above so that laser light from the semiconductor laser element is reflected nearly zero or once at the inner wall defining the lower portion 3*a* of the through-hole 3. Accordingly, with the inner wall defining the through-hole 3, the laser light from the semiconductor laser can be condensed efficiently on the wavelength converting member 2, so that the light extraction efficiency can be improved. For example, the through-hole 3 may be defined only by the lower portion 3*a* and the upper portion 3*b*. Also, a light-transmissive member such as sapphire may be disposed in the lower portion 3*a* of the through-hole 3, but the lower portion 3*b* is preferably hollow, i.e., filled with a gas. Hollow lower portion 3*a* allows a larger amount of the laser light from the semiconductor laser to reach the wavelength converting member 2 than the lower portion 3*a* provided with the light-transmissive member.

The through hole 3 shown in FIGS. 1A and 1B is formed in an approximately circular shape in a plan view. The total length L of the through-hole 3 is substantially the same as the thickness of the support member 4, for example, 280 μm. The length L1 of the lower portion 3*a* is 80 μm.

The lower portion 3*a* of the through-hole 3 can be defined in an approximately truncated cone shape, with an approximately trapezoidal shape in a longitudinal cross-sectional view as shown in FIG. 1B. The end portion at the light incident side of the lower portion 3*a* of the through-hole 3 is defined with a diameter D1 of 260 μm and the end portion at the light emitting side of the lower portion 3*a* of the through-hole 3 is defined with a diameter D2 of 200 μm.

The upper portion 3*b* can be an approximately reversed truncated cone shape in a longitudinal cross-sectional view. The end portion at the light incident side of the upper portion 3*b* of the through-hole 3 is defined with a diameter of 200 μm and the end portion at the light emitting side of the upper portion 3*b* of the through-hole 3 is defined with a diameter of 300 μm.

The shortest distance S between the opening at the light incident side of the through-hole 3, that is, the lower end of the through-hole 3, and the semiconductor laser element 1 is 200 μm.

The inner wall defining the through-hole 3, particularly, the inner wall defining the lower portion 3*a* is preferably provided with a reflecting film 14. Providing the reflecting film having a higher reflectance to laser light than that of the inner wall defining the lower portion 3*a* allows for an improvement in the arrival ratio of laser light incident on the lower portion 3*a* to the wavelength converting member 2. The reflecting film 14 can be made of silver or a silver alloy, for example. The reflectance of the reflecting film 14 is preferably 80% or greater, more preferably in a range of 80 to 95%. As shown in FIG. 1B, the reflecting film 14 can be provided not only on the lower portion 3*a* but also on the upper portion 3*b*. The reflecting film 14 can be formed with a small thickness of about several micro meters or less, so that the preferable ranges described above, such as of the widths D1 and D2 of the through-hole 3 can also be applied in situ as the widths D1 and D2 of the through-hole 3, or the like, when disposing the reflecting film 14. Alternatively, assuming the surface of the reflecting film 14 as the inner wall defining the through-hole 3, the preferable range of the width of the through-hole 3 described above can be employed.

Wavelength Converting Member 2

The wavelength converting member 2 is disposed in the through-hole 3 in the support member 4, more specifically, in the upper portion 3*b*.

The shape of the wavelength converting member 2 can be appropriately adjusted according to the shape defining the upper portion 3*b* of the through-hole 3. In particular, the wavelength converting member 2 preferably has a shape that is in conformity to the shape defining the upper portion 3*b* of the through-hole 3, and is in contact with the inner wall defining the upper portion 3*b* of the through-hole 3. With the shape as described above, the wavelength converting member 2 can be in tight contact with the support member 4, so that heat generated by light irradiated on the wavelength converting member 2 can be efficiently released to the support member 4.

The light incidence surface and the light emitting surface of the wavelength converting member 2 are, for example, flat and substantially parallel opposite surfaces. Either the light incident surface or the light emitting surface or the both may have a recess or a protrusion. Of those configurations, the light incidence surface and the light emitting surface are preferably arranged perpendicular to an axis indicating propagating direction of the laser light emitted from the semiconductor laser element, that is, to the optical axis, respectively.

The size of the wavelength converting member 2 can be appropriately adjusted to conform to the size of the through-hole 3. More specifically, depending on the type of the semiconductor laser element 1, the maximum width of the wavelength converting member 2 is preferably in a range of 0.1 to 3.0 mm. The width of the wavelength converting member 2 may not be uniform with respect to the penetrating direction of the through-hole 3. The thickness of the wavelength converting member 2 can be appropriately adjusted to conform to the size of the support member 4. For example, the thickness may be in a range of about 0.2 mm to about 1.0 mm. With this arrangement, the outer peripheral surface of the wavelength converting member 2 can be in contact with the support member 4, which allows for exerting efficient heat dissipation performance.

The wavelength converting member 2 is preferably made of a material having good optical transmittance. For example, when the wavelength converting member 2 is made of ceramics in which a fluorescent material and one or more other materials are mixed, the ratio of the fluorescent material with respect to the total weight of the wavelength converting member 2 may be preferably 50 wt % or less, more preferably 30 wt % or less. In addition to the above, the ratio of the fluorescent material with respect to the total weight of the wavelength converting member 2 may be preferably 1 wt % or greater. Alternatively, a single crystal of a fluorescent material may be used as the wavelength converting member 2. The wavelength converting member 2 made of a single crystal scarcely causing scattering of light compared to the wavelength converting member 2 made of ceramics. Accordingly, with the use of a single crystal of a fluorescent material as the wavelength converting member 2, the light extraction efficiency can be improved. Meanwhile, scarce scattering of light indicates that unevenness in intensity distribution of laser light is substantially directly reflected on the intensity distribution of light extracted from the wavelength converting member 2. However, in the light emitting device 10, light can be reflected at the inner wall defining the lower portion 3*a*, which allows reducing uneven intensity distribution of the laser light. Thus, even the wavelength converting member 2 is made of a single crystal, unevenness in the intensity distribution of light extracted from the wavelength converting member 2 can be reduced. Also, the wavelength converting member 2 is preferably made of a material having good light-resisting properties and heat-resisting properties so as not to experience deformation upon being irradiated by light of high output power. For example, the material may have a melting point in a range of 1,000° C. to 3,000° C., preferably in a range of 1,300° C. to 2,500° C., more preferably in a range of 1,500° C. to 2,000° C.

Examples of the material of the wavelength converting member 2 include ceramics. More specific examples of the material include aluminum oxide ($Al_2O_3$, melting point of about 1,900° C. to about 2,100° C.), silicon dioxide such as quartz glass ($SiO_2$, melting point of about 1,500° C. to about 1,700° C.), barium oxide (BaO, melting point of about 1,800° C. to about 2,000° C.), and yttrium oxide ($Y_2O_3$, melting point of 2,425° C.). Those materials may be used singly or a combination of two or more. Among those, good light-transmissive property and from view points of melting point, thermal conductive property, light-diffusing property, and so forth, material that contains aluminum oxide and/or silicon dioxide is preferable, and a material containing aluminum oxide is more preferable.

The wavelength converting member 2 made of the material as described above can withstand high temperature without melting, even when the semiconductor laser element produces higher output, and further, deformation and discoloration of the wavelength converting member 2 can also be avoided. Accordingly, the optical characteristics of the light emitting device can be maintained for a long period of time. Further, employing such a material that also has good thermal conductivity, heat due to the light source can be released efficiently.

The wavelength converting member 2 can be made of a single material or a plurality of materials, and a single layer structure or a layered structure can be employed.

The wavelength converting member 2 contains a fluorescent material. This allows conversion of the wavelength of light emitted from the semiconductor laser element 1, and typically, light of mixed color of the light from the semiconductor laser element 1 and the wavelength-converted light can be emitted to the outside.

The fluorescent material can be selected, for example, according to the wavelength of light from the light source to be used, color of light to be obtained, and so forth. Specific examples of the fluorescent material include a yttrium aluminum garnet (YAG) activated with cerium, a lutetium aluminum garnet (LAG) activated with cerium, a nitrogen-containing calcium aluminosilicate (CASN) activated with europium and/or chromium. Among those, a YAG fluorescent material that has good heat-resisting properties is preferable.

Plural types of fluorescent materials may be used in combination. For example, fluorescent materials of different emission colors can be used in combination with a ratio suitable to obtain a desired color of light, with adjusting color rendering properties and color reproductivity.

Such a plurality of type of fluorescent materials may be included in combination in the wavelength converting member of single-layer structure, or different fluorescent material can be included in respective layers in the wavelength converting member of multi-layer structure.

With the use of those fluorescent materials, the light emitting device can emit mixed-color light (for example, white light) of the first light of visible wavelength and the second light of visible wavelength can be obtained. Particularly, when the first light is blue light, the fluorescent material to be used in combination with the first light to emit white light, a yellow fluorescent material such as a YAG fluorescent material that can be excited by the blue light and emits yellow light with broad spectrum may be preferably used.

The light incidence surface and/or the light emitting surface of the wavelength converting member 2 may be optionally provided with a functional film such as an anti-reflection layer (AR layer) and/or a layer to be described further below. The light incident side and/or the light emitting side of the wavelength converting member 2 may be provided with a light-transmissive member such as sapphire.

In FIG. 1A, the wavelength converting member 2 is made of aluminum oxide (melting point: about 1,900° C. to 2,100° C.) containing 11 wt % of a YAG fluorescent material as the fluorescent material, with respect to a total weight of the wavelength converting member. The wavelength converting member 2 has an upper surface with a diameter of 0.5 mm, a lower surface with a diameter of 0.3 mm, and a thickness of 0.3 mm. The wavelength converting member 2 is firmly in contact with the support member 4 by melting a first light-transmissive member to be described below, and the wavelength converting member 2 itself is not melted.

First Light-transmissive Member

The first light-transmissive member can be used to firmly connect the inner wall defining the through-hole and the wavelength converting member by melting the first light-transmissive member. In this case, the first light-transmissive member is disposed in film shape on the inner wall, particularly on the inner wall defining the upper portion 3*b* of the through-hole 3.

For the material of the first light-transmissive member, an inorganic material can be used, for example, glass such as borosilicate glass, soda-lime glass, soda glass, lead glass, or the like is preferably used.

The first light-transmissive member has a thickness, for example on the inner wall defining the upper portion 3*b* of the through-hole 3, in a range of about 0.01 μm to about 5 μm, and preferably in a range of about 0.05 μm to about 3 μm.

Second Light-transmissive Member

A second light-transmissive member may be disposed in the upper portion 3*b* of the through-hole 3 in the support member 4 and/or at a location to cover the upper opening in the upper portion 3*b* of the through-hole 3 in the support member 4 so that the light emitting surface of the wavelength converting member 2 can be covered by the second light-transmissive member. The second light-transmissive member is made of a material having light-transmissive property, which can be, for example, selected from the materials exemplified for the first light-transmissive member.

The second light-transmissive member may contain the fluorescent material described above and/or a light scattering material or a filler material. With this arrangement, light passed through the wavelength converting member can be substantially uniform and also the color of the light can be adjusted.

Functional Film

Examples of a functional film include a film having appropriate light-transmissive properties and light-reflecting properties. For example, a short-pass filter that allows the first light to pass through and reflects the second light, or a long-pass filter that reflects the first light and allows the second light to pass through. Those films are arranged at appropriate locations to exhibit respective functions. For example, the long-pass filter can be arranged at the light emitting surface side, and the short-pass filter can be arranged at the light incident side of the wavelength converting member 2.

Components of Device

In the light emitting device 10, the semiconductor laser element 1 is fixed to the plate-shaped stem 7 with the use of the sub-mount 5 and the heat sink 6. The heat sink 6 and the stem 7 may be integrally formed. The semiconductor laser element 1 is enclosed by the support member 4 and the stem 7. A plurality of leads 8 to electrically connect to an external power source is arranged through a plurality of through-holes defined in the stem 7. The plurality of through-holes can be sealed by a sealing material made of low-melting point glass or the like. The semiconductor laser element 1 is electrically connected to the respective leads 8 via an electrically conductive member such as wires 9.

It is preferable that a light-condensing member such as a lens is not provided between the semiconductor laser element 1 and the support member 4. This arrangement allows for reduction in the size of the light emitting device 10, and also the use of a light-condensing member is avoided, which allows for reduction in the number of the components, and further, reduction in the manufacturing cost. In other words, with the use of fewer numbers of the components, laser light from the semiconductor laser element 1 can be efficiently condensed on the wavelength converting member 2.

In the light emitting device 10 having a configuration as described above, light emitted from the semiconductor laser element 1 passes through the through-hole of the support member 4 and is irradiated on the wavelength converting member 2, then, light from the wavelength converting member 2 is emitted to the outside from the light emitting device 10.

With the configuration as described above, the wavelength of light can be converted by the wavelength converting member 2 to obtain light of a desired color, while achieving nearly uniform optical intensity and distribution of chromaticity in light passing through the wavelength converting member 2.

Second Embodiment

A light emitting device 20 according to a second embodiment has a configuration similar to that of the light emitting device 10 according to the first embodiment, except that, as shown in FIG. 2, a through-hole 23 in the support member 24 is defined so that an upper portion 23*b* is connected to a lower portion 23*a* with an opening width, larger than that of the upper end of the lower portion 23*a*, and also the opening width of the upper portion 23*b* is substantially uniform in a longitudinal direction of the through-hole 23.

The configuration as described above allows for downsizing of a light emitting device that employs a semiconductor laser element, while achieving an improvement in the light extraction efficiency.

Third Embodiment

A light emitting device 30 according to a third embodiment has a configuration similar to that of the light emitting device 10 according to the first embodiment, except that, as shown in FIG. 3, a through-hole 33 in the support member 34 is defined so that an upper portion 33*b* is connected to a lower portion 33*a* with an opening width, larger than that of an upper end of the lower portion 33*a*, and also from the light incident side toward the light emitting side, the opening width of the upper portion 33*b* is substantially uniform in part and then increasing toward the light emitting side.

The configuration as described above allows for downsizing of a light emitting device that employs a semiconductor laser element, while achieving an improvement in the light extraction efficiency.

Fourth Embodiment

Figure 4:
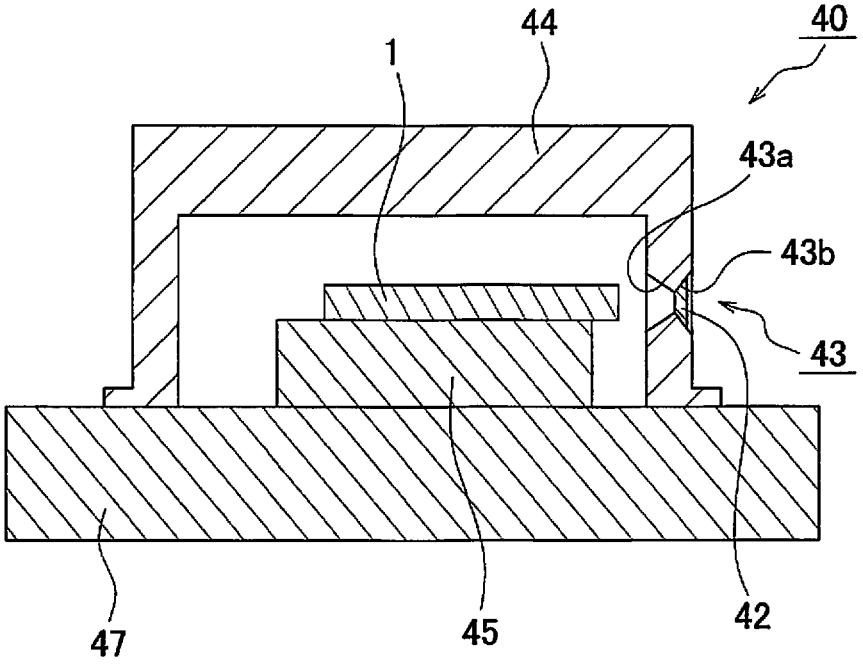
FIG. 4 is a schematic cross-sectional view showing a light emitting device according to a still another embodiment of the present invention.

A light emitting device 40 according to a fourth embodiment has a configuration similar to that of the light emitting device 10 according to the first embodiment, except that, as shown in FIG. 4, a semiconductor laser element 1 is disposed on a submount 45 so as to be substantially in parallel to an upper surface of a base member 47, and a through-hole 43 is defined, in conformity to a light emitting surface of the semiconductor laser element 1, in a lateral wall of the support member 44.

The configuration as described above allows for downsizing of a light emitting device that employs a semiconductor laser element, while achieving an improvement in the light extraction efficiency. FIG. 4 is a schematic cross-sectional view illustrating a state of all members included in the light emitting device 40 being cut along the penetrating direction of the through-hole 43.

Fifth Embodiment: Evaluation of Light Intensity Distribution

Figure 7:
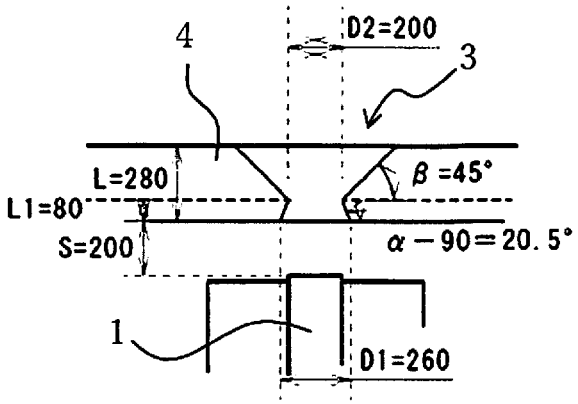
FIG. 7 is a diagram showing a part of a light emitting device A of one example of present invention.
Figure 8:
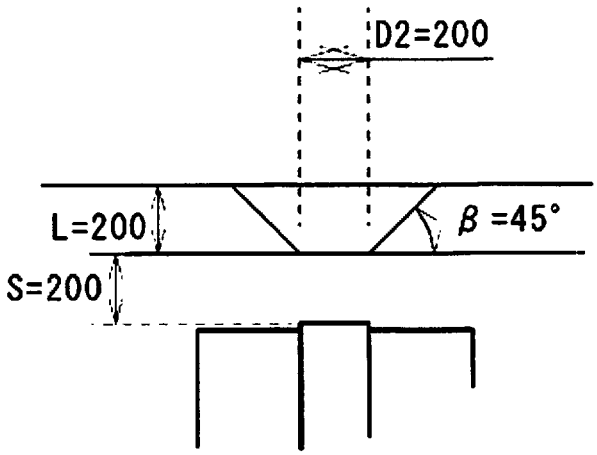
FIG. 8 is a diagram showing a part of a light emitting device B of a comparative example.

A light emitting device A according to one embodiment of the present invention (FIG. 7) and a light emitting device B as its comparative example (FIG. 8) were provided. For each of the light emitting devices, light intensity distribution was simulated under conditions shown below. The results are shown in Table below. The values in the table other than angles are in microns (μm).

Figure 5:
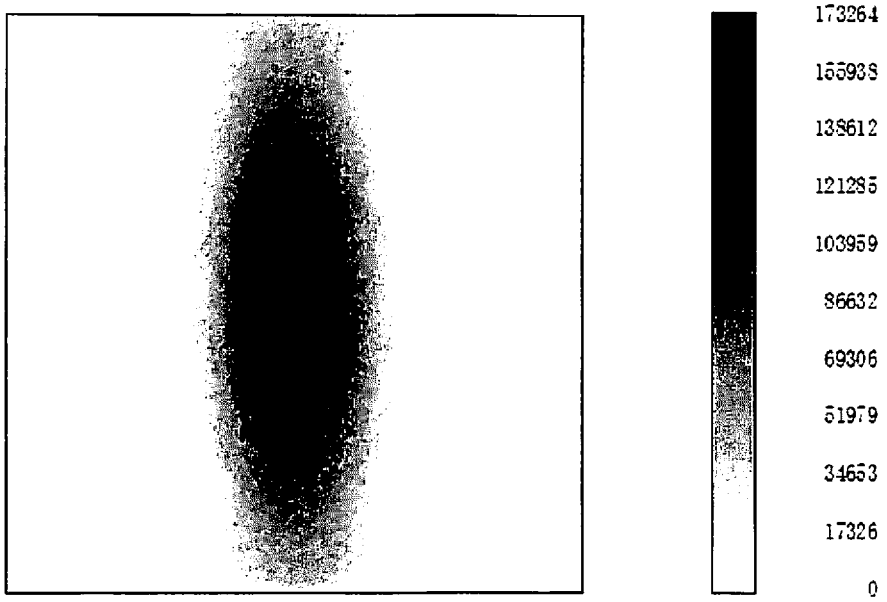
FIG. 5 is a diagram showing an intensity distribution of laser light irradiated on a wavelength converting member of the light emitting device shown in FIG. 1A.
Figure 6:
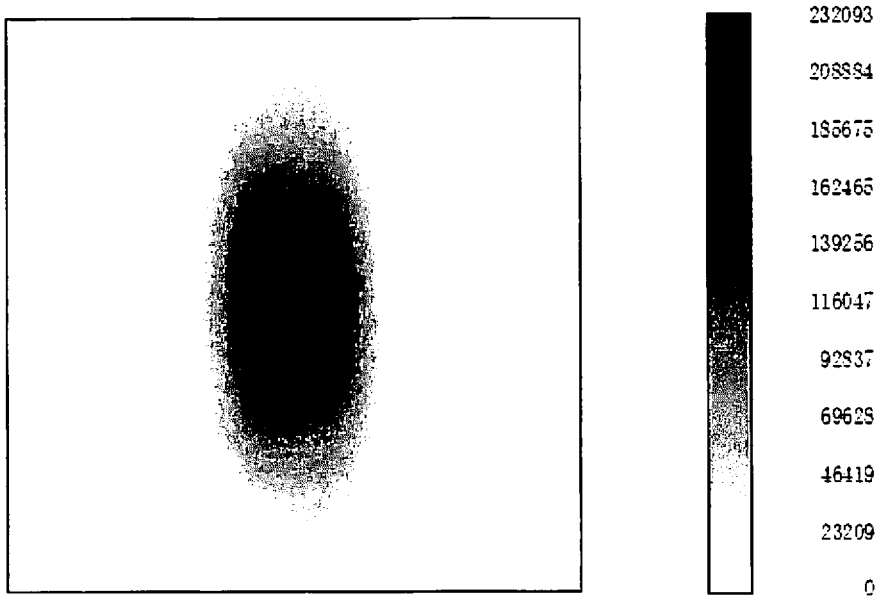
FIG. 6 is a diagram showing an intensity distribution of laser light irradiated on a wavelength converting member of a comparative light emitting device.

| Light Emitting Device A of one Example of Present Invention (FIG. 7) | Light Emitting Device B of Comparative Example (FIG. 8) |
|---|---|
| Number of Laser Rays for Analysis: 1,000,000<br>Total LD Output Power. 10 W<br>Number of Divisions of Angle: 256<br>Number of Division of Radius: 128<br>Reflectance of Inner Wall defining Through-hole: 90% | |
| Intensity Distribution of Laser Light FIG. 5 | Intensity Distribution of Laser Light: FIG. 6 |
| Ratio of High Intensity Area: 2.1%<br>Reaching Ratio of Laser Light to Wavelength Converting Member 98.6% | Ratio of High Intensity Area: 6.6%<br>Reaching Ratio of Laser Light to Wavelength Converting Member 97.9% |

In the light emitting device A, the opening diameter D1 at the light incident side of the lower portion 3*a* of the through-hole 3 was adjusted to allow 99.6% of laser light entering the opening. In the light emitting device B, the opening diameter D2 at the light incident side of the lower portion 3*a* of the through-hole 3 was adjusted to allow 97.9% of laser light entering the opening. The opening diameter D2 at the light emitting side of the lower portion 3*a* of the through-hole 3 of the light emitting device A was set to 200 μm. The shortest distance S from the semiconductor laser element 1 to the through-hole 3 was set to S=200 μm in both the light emitting devices A and B. Cross-sectional shape (cross-section substantially perpendicular to the optical axis of the laser light) of the through-hole 3 was set to circular in both the light emitting devices A and B. A cross-section of laser light emitted from the semiconductor laser element 1 was set to an elliptic shape with a longitudinal width (perpendicular to the surface of the semiconductor layer) greater than a lateral width (parallel to the surface of the semiconductor layer). With this arrangement, in the light emitting device A, the lower portion 3*a* of the through-hole 3 mainly reflected both end portion in a longitudinal direction of the laser light.

FIG. 5 shows an intensity distribution of laser light at an interface between the lower portion 3*a* and the upper portion 3*b* of the through-hole 3 of the light emitting device A, and FIG. 6 shows an intensity distribution of laser light at an opening edge at the laser light incident side of the through-hole of the light emitting device B. The laser light incident surface of the wavelength converting member 2 is assumed to be placed at each of those locations. Therefore, FIG. 5 and FIG. 6 can respectively show the intensity distribution of the laser light incident on the wavelength converting member 2. In each of the figures, the ratio of high intensity area was determined as a ratio of area where the irradiation intensity is $1.5\times10^5$ (W/cm$^2$) or greater with respect to a planar dimension of the laser light incident surface of the wavelength converting member 2. The arrival ratio of the laser light to the wavelength converting member 2 was determined as a ratio of number of laser rays emitted for analysis reaching the laser light incident surface of the wavelength converting member 2 with respect to the total number of laser rays emitted for analysis as 100%.

In the light emitting device A described above, α-90 was set to 20.5°, but similar results were observed when α-90 was set in a range of 14° to 20°. That is, compared to the light emitting device B, the light emitting device A exhibited a decrease in the ratio of high intensity area.

From the results, efficient reduction in the uneven intensity distribution of laser light was confirmed in the light emitting device A. That is, both end portions in the longitudinal direction of the laser light were reflected by the inner wall defining the lower portion 3*a* and directed to an upper end of the lower portion 3*a*, thus, as shown in FIG. 5, the emission intensity of the both end portions in the longitudinal direction of the laser light increased and the difference in the intensity between the center portion and the peripheral portion is decreased. Accordingly, reduction of unevenness in the chromaticity of light extracted from the wavelength converting member 2 can be realized. Therefore, a need for increasing the thickness of the wavelength converting member 2 to scatter light becomes unnecessary, and thus the wavelength converting member 2 of a small thickness becomes possible to be used. Thus, scattering of light by the wavelength converting member 2 can be reduced and the light extraction efficiency can be further improved. As described above, peripheral portion of cross section of laser light is reflected at the lower portion 3*a* of the through-hole 3, which allows a reduction in divergence of laser light that in turn can realize emission of the light emitting device A with higher luminance without using a light-condensing member such as a lens. Accordingly, the number of components of the light emitting device 10 can be reduced, and thus a reduction in the cost and size can be realized.

The light emitting device according to the present invention can be used as a light source for display devices, luminaires, backlight unit of liquid crystal displays, projectors, in vehicular applications, endoscopes, and so forth.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A light emitting device comprising:

a semiconductor laser element configured to emit a first light;

a wavelength converting member configured to emit a second light upon being irradiated by the first light; and a support member defining a through-hole allowing an optical path of the first light to pass through, the through-hole being defined by, in order from a light incident side to a light emitting side with respect to the first light, a lower portion with opening width decreasing from the light incident side to the light emitting side, and an upper portion where the wavelength converting member is fixed, the upper portion of the through-hole being defined with opening width increasing from the light incident side to the light emitting side, the semiconductor laser element being disposed at a location allowing the first light to enter the lower portion of the through-hole while also allowing a part of the first light to be reflected at a wail defining the lower portion of the through-hole.

2. The light emitting device according to claim 1, wherein a lens is not provided between the semiconductor laser element and the lower portion of the through-hole.

3. The light emitting device according to claim 1, wherein a reflecting film is provided on the wall defining the lower portion of the through-hole.

4. The light emitting device according to claim 1, wherein a shortest distance between the semiconductor laser element and an opening at the light incident side of the through-hole is smaller than the opening width at the light incident side of the through-hole.

5. The light emitting device according to claim 1, wherein a shortest distance between the semiconductor laser element and an opening at the light incident side of the through-hole is smaller than three times a length of the lower portion of the through-hole.

6. The light emitting device according to claim 1, wherein an inner wall of the support member defining the lower portion of the through-hole has an inclination angle in a range of 10 to 25 degrees with respect to an optical axis of the first light.

7. The light emitting device according to claim 3, wherein the reflecting film is made of silver or a silver alloy.

8. The light emitting device according to claim 1, wherein the lower portion of the through-hole is hollow.

9. The light emitting device according to claim 1, wherein the support member is made of ceramic, metal, or a complex material of ceramic and metal.

10. The light emitting device according to claim 1, further comprising a stem joined to the support member to hermetically seal the semiconductor element.

11. The light emitting device according to claim 1, wherein an inner wall of the support member defining the upper portion of the through-hole has an inclination angle in a range of 10 to 45 degrees with respect to an optical axis of the first light.

12. The light emitting device according to claim 1, wherein the upper portion of the through-hole is formed with an opening width that is the same as or greater than an opening width of an upper end of the lower portion of the through-hole.

13. The light emitting device according to claim 1, wherein an opening width at the light incident side of the through-hole is in a range of 0.1 mm to 5.0 mm.

14. The light emitting device according to claim 1, wherein an opening width of an upper end of the lower portion of the through-hole is in a range of 0.05 mm to 4.0 mm.

15. The light emitting device according to claim 1, wherein the wavelength converting member is in contact with an inner wall of the support member defining the upper portion of the through-hole.

16. The light emitting device according to claim 1, further comprising a first light-transmissive member disposed on the upper portion of the through-hole so as to connect an inner wall of the support member defining the through-hole and the wavelength convening member.

17. The light emitting device according to claim 1, further comprising a second light-transmissive member disposed in at least one of the upper portion of the through-hole and at a location that covers art upper opening of the upper portion of the through-hole so as to cover a light emitting surface of the wavelength converting member.

18. The light emitting device according to claim 1, wherein the upper portion of the through-hole is connected to the lower portion of the through-hole with an opening width larger than an opening width of an upper end of the lower portion of the through-hole, and the opening width of the upper portion of the through-hole is substantially uniform in a longitudinal direction of the through-hole.

19. The light emitting device according to claim 1, wherein the upper portion of the through-hole is connected to the lower portion of the through-hole with an opening width larger than an opening width of an upper end of the lower portion of the through-hole, and from the light incident side toward the light emitting side, the opening width of the upper portion is substantially uniform in part and then increases toward the light emitting side.

* * * * *